United States Patent [19]

Goldhammer

[11] Patent Number: 4,512,252

[45] Date of Patent: Apr. 23, 1985

[54] BALING PRESS

[75] Inventor: Albert Goldhammer, Überlingen, Fed. Rep. of Germany

[73] Assignee: Firma Feinwerktecnik Schleicher & Co., Markdoff, Fed. Rep. of Germany

[21] Appl. No.: 362,478

[22] Filed: Mar. 26, 1982

[30] Foreign Application Priority Data

Mar. 31, 1981 [DE] Fed. Rep. of Germany ..... 3112914

[51] Int. Cl.[3] ..... B30B 15/00

[52] U.S. Cl. ..... 100/53; 100/255

[58] Field of Search ..... 100/229 A, 255, 53, 100/45, 240; D15/9; 49/114, 115, 170, 163, 160, 143, 144, 145

[56] References Cited

U.S. PATENT DOCUMENTS 1,112,723 10/1914 Schick ..... 100/255

3,601,953 8/1971 Boyd ..... 100/255 X 4,169,411 10/1979 Lutz ..... 100/255

*Primary Examiner*—Billy J. Wilhite

*Attorney, Agent, or Firm*—Lackenbach Siegel Marzullo Presta & Aronson

[57] ABSTRACT

The subject matter of the present invention is a feed door for a baling press with a vertical work direction, where at one press case there is fastened a press door tiltably at hinges, in order to bring material to be pressed into the work room of the baling press. The invention has the object to improve the feed door such that a large dimensioned feed opening is created upon formation of a lower support table attached horizontally tiltable at the press case, without that the feed door required for this purpose leads to a hindrance for the user of the press. For resolving the object set forth, the invention is characterized in that the feed door is separated along a horizontal line and comprises a lower and an upper part.

12 Claims, 10 Drawing Figures

BALING PRESS

Figure 1:
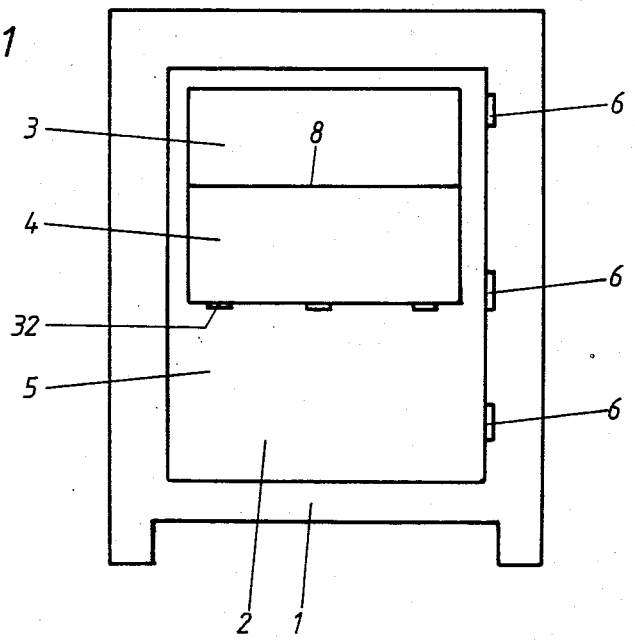

The object of the invention is an improved feed door for a baling press with preferably a vertical working direction, where a press door is tiltably fastened at hinges to a press case and where a feed opening closable with a feed door is disposed in the press door, in order to bring material to be pressed into the work area of the press.

A press shield is generally disposed in baling presses with a vertical mode of operation, such that it is in rest position in its upper end position and that it is in a work position in its lower end position. A work area results therefrom at the bottom and it is necessary to provide a feed opening above the work area. The feed opening is disposed about a the level of the chest of a user. The feed openings used up to the present time suffered from the disadvantage of relatively small dimensions such that the throwing in of bulky goods was not possible except after first comminuting of the bulky goods to a small size. For example, with vertical baling presses there are no feed openings known, through which it is possible to slide in subdivided pallets with a basis area of $80 \times 120$ centimeters. If now one enlarges the feed opening such that the sliding in of such pallets into the work area of the vertical baling press becomes possible, then the feed door has to be so big that in its open position the operator is no longer able to throw the materials directly into the work area of the press, if one fastens the feed door tiltably at the press case along a horizontal line. If one employs such a huge feed door with a vertical hinge line, then this feed door will protrude far into the work area of the user such that injuries can very likely result and in addition no support table is provided for assisting in the positioning of goods to be slid in through the feeding opening and into the work area of the baling press.

It is an object of the present invention to improve a feed door such that upon formation of a lower, horizontally tiltable support table fastened to the press case a large dimensioned feed opening is created without that the feed door required leads to a hindrance for the user of the press.

The solution of the object of the invention is characterized in that the feed door is separated along a horizontal line and comprises a lower and an upper part.

An essential feature of the invention is therefor the separation of the feed door into upper and lower door parts.

It is insignificant within the framework of the present invention if the feed door closing the feed opening is disposed immediately at the press case, or if the feed opening with the feed door belonging to it is disposed at or within a press door.

A press door is required in order to be able to remove after each performed press process the press bales from the work area of the press. In the first mentioned case of an embodiment, the press door would be located at another wall face of the baling press, for example at the left side wall, while the feed opening with the feed door would be provided at the right side wall.

According to the second embodiment, the press door is disposed at the front face of the baling press and the feed opening with the feed door is provided within the press. With the opening and closing of the press door then necessarily also the feed door is moved jointly.

As set forth, it is insignificant within the context of the present invention, if the feed opening with the corresponding feed door is located directly at the press case or within a press door itself hinged to the press case.

Additional possibilities exist for the separation of the feed door into two door parts.

The first possibility provides that the lower door part is fastened by way of a horizontally running hinge at the upper tiltable part of the lower door part. Upon opening of the lower door part then the upper door part is folded down and protrudes in a vertical plane to the bottom, where the lower door part provides a horizontal support table.

According to a second embodiment it is provided that the upper door part is fastened tiltably with a horizontally running hinge disposed at the upper part of the press case or at the upper part of the press door. Here, upon folding down of the lower door part into the horizontal plane at the same time also the upper door part is swung up into a horizontal plane or into an inclined upward direction.

A third embodiment refers to the situation where the lower door part is tiltable around horizontal hinges and where the upper door part is slidably disposed at the press case or at the press door.

The upper door part is provided as a kind of shift closure, where the shift drive of the upper door part is performed via the tilting of the lower door part. Thus a single hand motion and a single opening process are performed, by way of which the two door parts can be opened together and synchronously.

In order to provide a particularly wear-resistant, functionassured and maintenance free shifting operation, it is preferred that the shifting operation of the upper door part be provided via a cable control, which is attached to a first attachment point at the tiltable part of lower door part and is guided via deflection rollers and is attacked at a second attachment point at the upper door part.

The cable control is lengthened with the folding down of the lower door part into the horizontal final position and this increase in length is employed to pull the upper door part into its open position.

In order to assure that with the closure of the lower door part the upper door part goes back into the lowered closure position, it is preferred if the spring loaded upper door part is pretensioned in the closure direction by attaching the one end of the cable control to one attachment point of the door part, and the other part which is pretensioned via a spring against the case or the press door.

Thus, it is assured that upon closure of the lower door part, upon transfer from the horizontal open position into the vertical closed position, the upper part always transfers from its pulled up open position into the lowered closed position under the force of the spring.

In order to provide further safety in the closure position of the upper door part, the upper door part is provided with a control cam for closing the upper door part, which control cam in the closure position of the upper door part removes the cam out of the swivel path of the lower door part which is directed in a closure direction. The assurance of closure of the upper door part is important, since it is to be avoided that during the passage of the press shield at the feed door the same be completely closed. On the one hand thereby no material shall escape to the outside from the press space and on the other hand it is not possible for the user to reach into the press space of the vertical baling press during the work step. A solution is provided in that at the open position of the upper and lower door part a spring loaded cam protrudes into the feeding opening, and into the tilting path of the lower door part.

Thus, it is assured that the closure of the lower door part succeeds only then, when the upper door part is completely in a closure position, which upper door part is constructed as a shift closure. For assuring this function, the cam is disposed at the free, tiltable end of a spring loaded control lever attached to the press case and the tilting of the control lever is performed against the force of the spring by way of a corunning control cam in the shift guide at the upper door part. Thus the upper door part removes the cam disposed at the spring loaded control lever with the control cam from the closure path of the lower door part in its closure position.

The invention also provides an electrical display of the closure function and for further assurance of the closure position an actuation cam is disposed at the lower door part, which cam actuates in the closed position a switch disposed at the press case or at the press door. The switch is thus only operated, if the lower door part is completely in a closure position, and if the upper door part also is completely in the closed position.

The invention is illustrated in more detail by way of the attached and additional features of the invention and advantages of the invention can be gathered from the drawing and the description of the invention as set forth herein.

Figure 5:
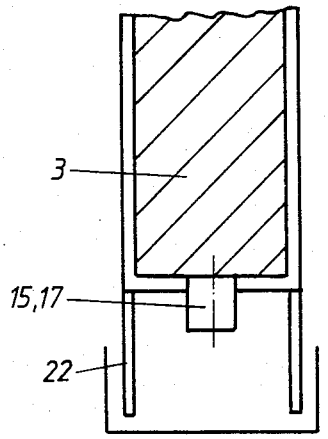
Figure 2A:
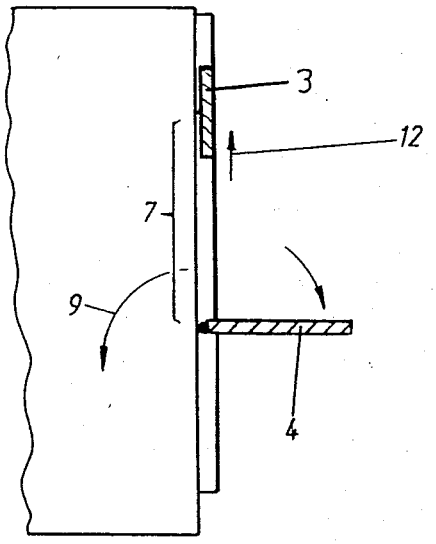
Figure 2B:
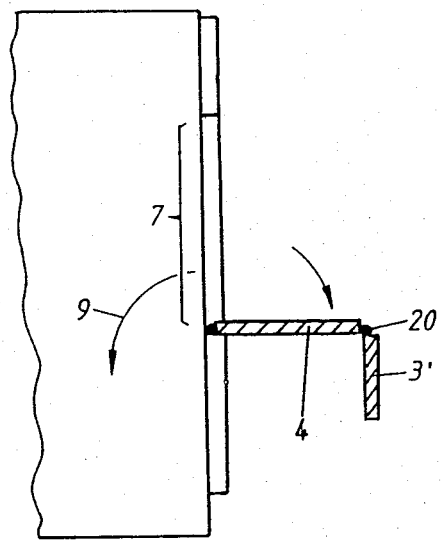
Figure 2C:
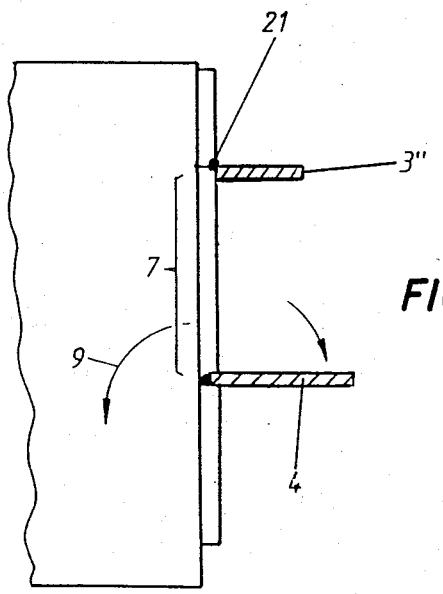
Figure 4:
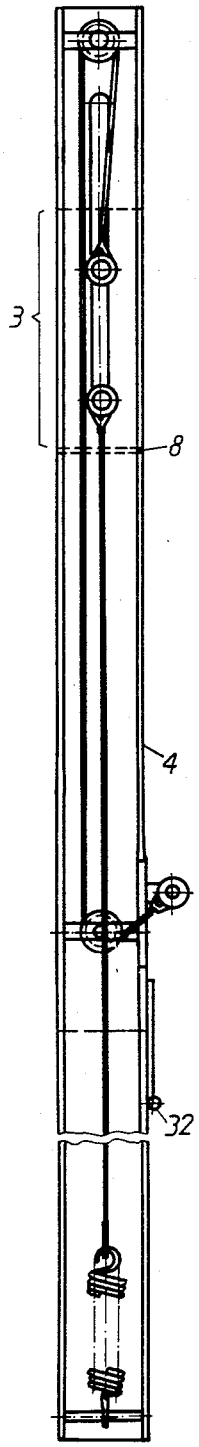
Figure 3:
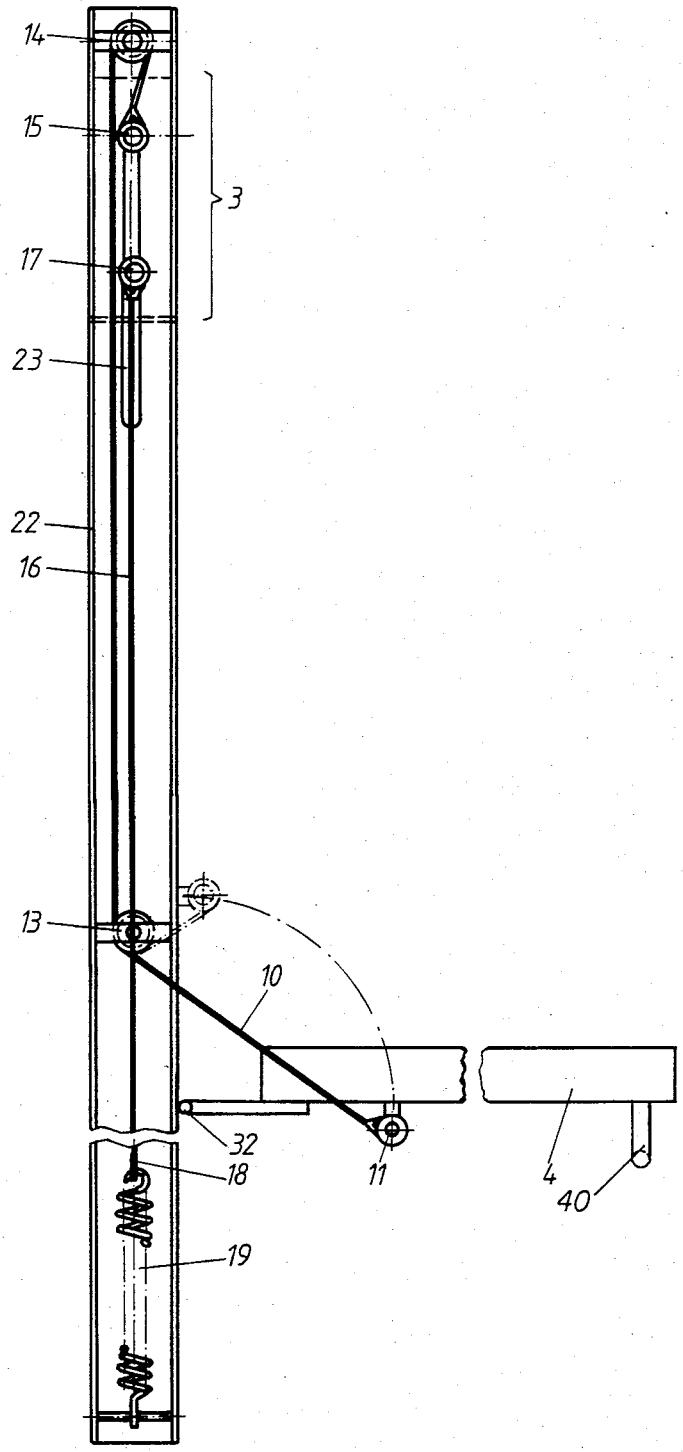
Figure 6:
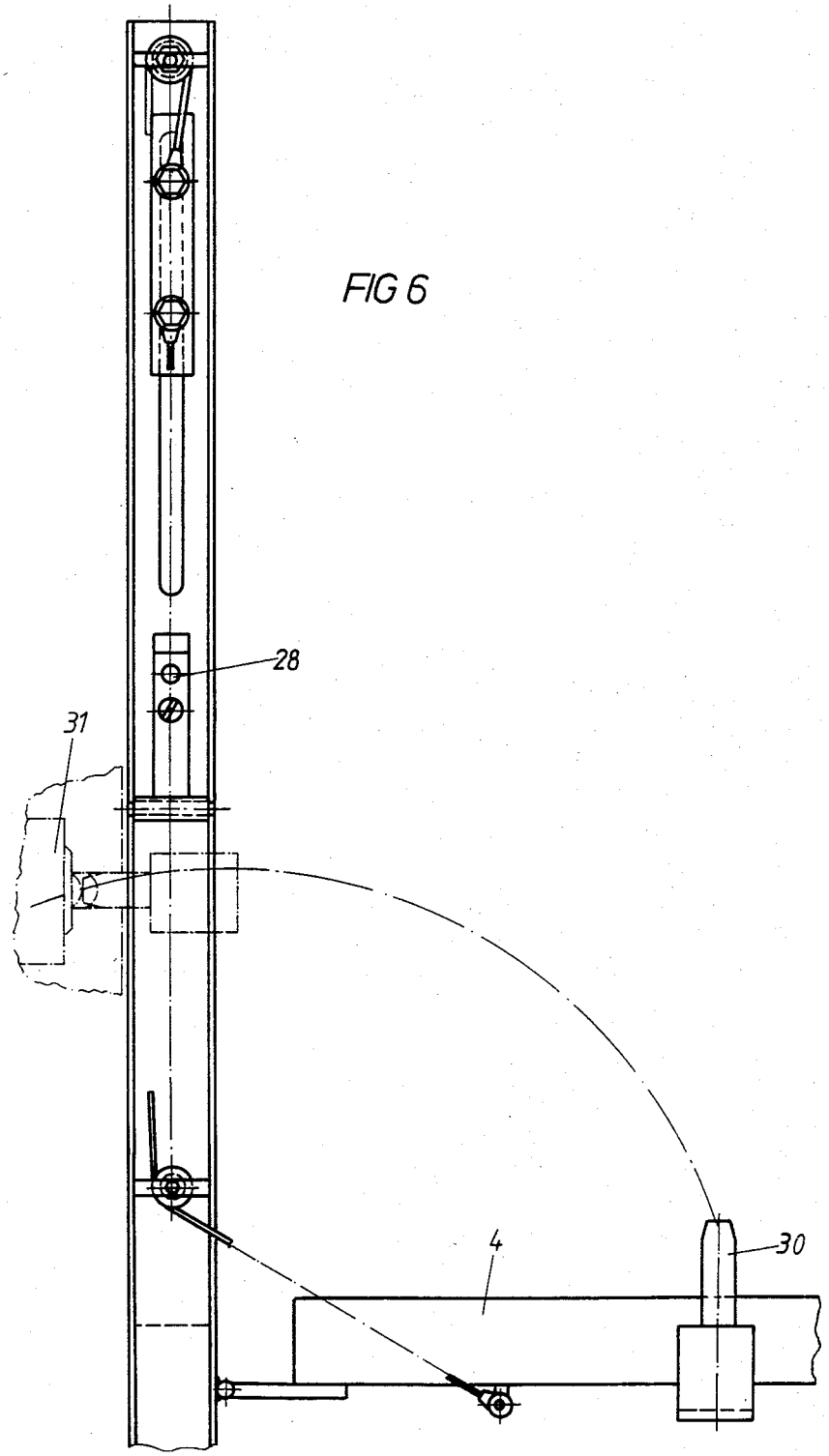
Figure 8:
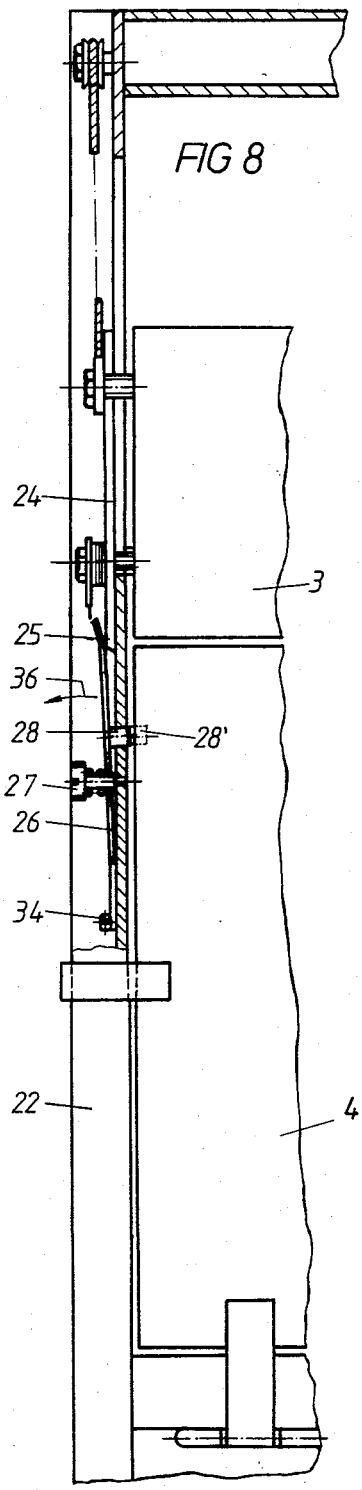
Figure 7:
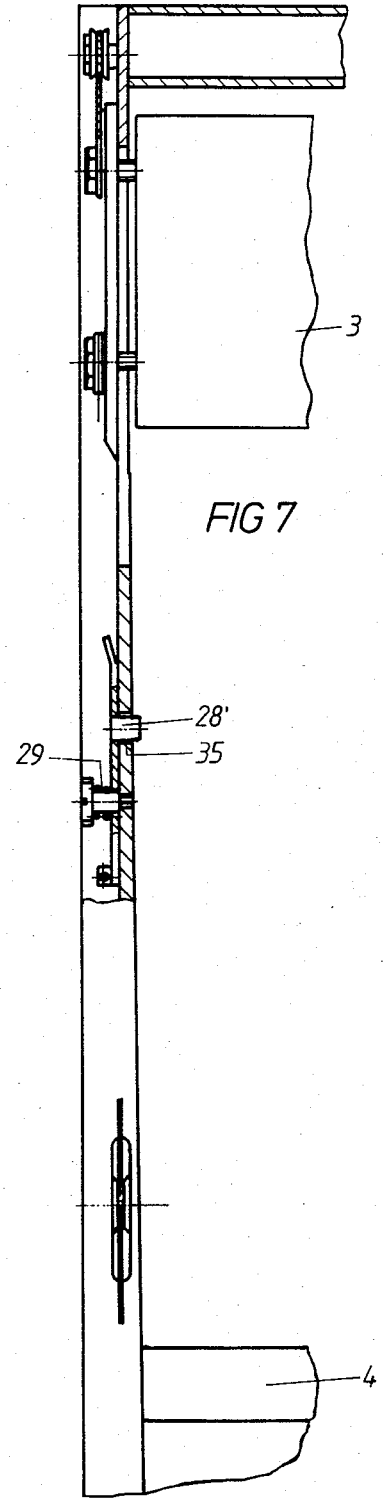

In the drawings:

FIG. 1 a schematic front view of a vertical baling press with a feed door according to the invention;

FIG. *2a* is a diagrammatic side view of a preferred embodiment of the improved baling press of the invention with the feed door shown open;

FIGS. *2b* and *c* are representations or views similar to that of FIG. *2a*, but showing two further embodiments of suitable door arrangements for use in the practice of the invention;

FIG. 3 a schematic drawn section through the feed door in the embodiment of the upper door part as a closure shift in the open position;

FIG. 4 the same representation as in FIG. 3 in closed position;

FIG. 5 a plan view onto the shift guide of the upper door part according to FIGS. 3 and 4;

FIG. 6 a safety closure for the upper door part with a representation of the opened lower door part;

FIG. 7 a side view of the safety closure according to FIG. 6 in the open position; and FIG. 8 a side view of the safety closure in the closed position.

FIG. 1 shows a front view of a vertical press 1 with a press door 2, which is disposed at vertically superposed hinges 6 at the press case. As already set forth above, it is not important in the context of the invention if the feed door is disposed within the press door 2 itself or located in the press case. In the latter case the press door 2 would be located at another place of the vertical press 1.

According to the present embodiment the feed door is disposed in the press door 2. It comprises an upper door part 3 and a lower door part 4, where the lower door part 4 is foldably provided by way of horizontally disposed hinges 32. The separation between the upper door part 3 and the lower door part 4 is provided along a horizontal line 8, which in general is not in the middle of the feed opening 7. In order to obtain a support table as large as possible, therefor the lower door part 4 is provided larger than the upper door part 3.

Since the feed door covering the feed opening 7 comprises an upper door part 3 and a lower door part 4 and it thus subdivides the press door 2 also into an upper part with feed opening 7 and a lower fixed position door part 5.

Thus the complete work area of the vertical press 1 is accessible upon opening of the press door 2 and the finished pressed bale, which has formed at the lower part near the floor of the case, can be removed.

FIGS. *2a* *2b* and *2c* show three different embodiments of the construction of upper door parts. According to a first preferred embodiment shown in FIG. *2a*, the upper door part is formed as a shift part, which is guided in the direction of arrow 12 and in opposite direction thereto in a shift guide of the press door. Here a half-opened position is shown, and the feed opening 7 extends over the indicated region.

As shown in the FIG. *2b* embodiment, the lower door part can be disposed tiltably at the front, swivel end of the lower door part 4 by way of a horizontal hinge 20. The upper door part 3' is then folded down in the folded out position of the lower door part 4 and thus does not interfere with the operation of the press, where the user throws in his material in the direction of arrow 9 over the lower door part 4 into the work area of the vertical press 1.

As shown in the FIG. *2c* embodiment, the upper door part 3'' can be disposed tiltably at the upper part of the press door 2 by way of horizontal hinges 21 and also shown is the open position of the door part 3''.

As a preferred embodiment only the formation of the door part 3 as a shift piece is illustrated in more detail in the following. For this purpose, a synchronous drive is provided for the upper door part 3, which is illustrated in detail by way of the FIGS. 3, 4 and 5.

The lower door part 4 is fastened tiltably to the press door 2 of the vertical press 1 by way of horizontal hinges 32 (compare FIG. 3). The one end of a cable control 10 is set to an attachment point 11 at the free, tiltable part of the lower door part 4, which runs via a deflection roller 13 attached in the frame 22 of the press door 2 and which is guided with a longer piece parallel in the frame 22 of the press door 2. It is again guided via a deflection roller 14 attached to the frame at the upper side and is then set to a second attachment point 15 at the upper end of the upper door part 3. The attachment points 15 and 17 are bolts according to FIG. 5, which protrude into the frame 22 and which penetrate through an elongated hole 23. The elongated hole 23 forms at the same time the vertical shift guide of the upper door part 3. Only one side of the drive and of the guide of the upper door part 3 and of the lower door part 4 is shown in FIGS. 3 and 4; the oppositely disposed side is constructed identically.

FIG. 4 shows the closed state of the door part 4 and shows at the same time that substantially no intermediate space is disposed at line 8 forming the separation line between the lower part of the upper door part 3 and the upper part of the lower door part 4, such that by way of this intermediate space it is not possible to grip into the press space of the press. At the lower door part 4, any suitable handle or conventional V-shaped rod-like handle 40 can also be provided so as to extend upwardly beyond the line 8 such that the lower door part 4 is not gripped at the front edge during closure and the fingers do not pass into the line 8 during closure, that is, into the slot between the upper and the lower door part 3, 4.

The FIGS. 6, 7, and 8 show a safety closure provision of the upper door part which assures that the lower door part 4 can only then be fully closed, if also the upper door part is in its complete closure position. For this purpose, a control cam 24 is connected to the upper door part 3 on the side of the upper door part 3 according to FIGS. 7 and 8, which cam runs in the U-shaped frame 22. The lower end of the control cam 24 is provided as a tip 25.

A tiltable control lever 26 is fixed with respect to the case or to the frame and is disposed and coordinated to the tip 25, which control lever 26 is rotatably attached to the frame 22 of the press door 2 at the hinge point 34. A stopping cam 28 is disposed at the free tiltable part of the control lever 26, which protrudes through a recess 35 at the frame 22 and into the closure path of the lower door part 4. The open position of the upper door part 3 is shown in FIG. 7, where it can be recognized that the cam 24 would prevent a closure of the door part 4. A closure is always then prevented, if the upper door part 3 in not also disposed in the complete closure position.

It is provided as shown in FIG. 8 for the transfer into the completely closed position that the tip 25 of the control cam 24 carries the control lever 26 in the direction of arrow 36 such that the blocking cam passes from its position 28' into the position 28, that is, into the tilting range of the lower door part 4. The tilting in the direction of the arrow 36 occurs against the force of a helical spring 29, which is disposed at the threaded shaft of a set screw 27.

The engagement path of the blocking cam 28, 28' into the closure path of the lower door part 4 can be set with the set screw 27.

According to FIG. 6, an additional electrical safety device is provided, in that an actuation cam 30 is set at the free, tiltable part of the lower door part 4, which actuation cam 30 actuates in the completely closed position of the lower door part 4 a switch 31 according to FIG. 6(shown in dash-dotted representation). This switch then shows, that the door is completely closed and releases the current for the electrical drive means of the vertical press 1. In case the door had not been closed completely, for example, if the upper door part is not disposed in the complete closure position (then the blocking cam 28' protrudes into the closure path), and the switch 31 is thus not actuated and a corresponding warning display can be provided; in the same way the electrical drive means are then put out of operation.

I claim:

1. A baling press apparatus comprising:

a press frame having a working chamber area;

a press door movably fastened to said press frame for providing access to said working chamber area;

a feed opening in said apparatus enabling material to be baled to be inserted into said working chamber area so as to be pressed in said working chamber area;

a feed door provided at said feed opening, being movable for opening and closing of said feed opening;

the feed door being divided into upper and lower door parts by a horizontal partition line; and said upper door part being directly connected to said lower door part by drive means for actuating said upper door part in response to actuation and movement of said lower door part.

2. A baling press according to claim 1, further including safety means for insuring the closure of said upper door part, said safety means having cam means cooperating with locking means comprising a projection for projecting into a path of movement of said lower door part of said feed door, and said cam means being adapted to remove said projection out of said path.

3. A baling press according to claim 2, wherein said projection is provided at a movable end of a spring-loaded pivotable control lever attached to said press frame, and a control lever is provided to pivot against the force of said spring means by the cam means, which is movable in guide means for said upper door part.

4. A baling press according to claim 3, including an actuating means provided at the lower door part, which, in the closing position of the lower door part, actuates a switch attached to said press frame.

5. A baling press according to claim 1, wherein said drive means includes flexible traction means attached to a first attachment point at said lower door part, which attachment point is located at a predetermined distance from the horizontal axis, and said flexible means being guided by deflection rollers and being connected to a second attachment point at said upper door part.

6. A baling press according to claim 5, wherein said upper door part is urged in its closing direction by spring means.

7. A baling press apparatus comprising:

a press frame having a working chamber area;

a press door movably fastened to said press frame for providing access to said working chamber area;

a feed opening in said apparatus enabling material to be baled to be inserted into said working chamber area so as to be pressed in said working chamber area;

a feed door provided at said feed opening, being movable for opening and closing of said feed opening;

the feed door being divided into upper and lower door parts by a horizontal partition line; and said lower door part being arranged to pivot about a horizontal axis and said upper door part is a sliding door.

8. A baling press according to claim 7, wherein said upper door part is driveably connected to said lower door part by drive means for actuating said upper door part in response to actuation of said lower door part.

9. A baling press according to claim 7 or 8, wherein said drive means including flexible traction means attached to a first attachment point at said lower door part, which attachment point is located at a predetermined distance from the horizontal axis, and said flexible means being guided by deflection rollers and being connected to a second attachment point at said upper door part.

10. A baling press according to claim 9, wherein said upper door part is urged in its closing direction by spring means.

11. A baling press according to claim 9, wherein said horizontal axis about which said lower door part is arranged to pivot comprises hinge means.

12. A baling press according to claim 7, wherein the feed opening is provided in said press door and said upper and lower door parts are provided in said press door.

* * * * *